US005280798A

United States Patent [19]

Helm

[11] Patent Number: 5,280,798

[45] Date of Patent: Jan. 25, 1994

[54] PROTECTIVE SYSTEM FOR GOLF CLUBS AND BAG

[76] Inventor: Eugene I. Helm, 780 SW. 48th, Portland, Oreg. 97221

[21] Appl. No.: 854,348

[22] Filed: Mar. 19, 1992

[51] Int. Cl.[5] ..... A45C 13/40

[52] U.S. Cl. ..... 135/16; 135/34.2; 150/159; 150/160; 206/315.2; 206/315.4

[58] Field of Search ..... 150/154, 159, 160, 166, 150/167; 135/16, 34, 99; 206/315.2, 315.3, 315.4

[56] References Cited

U.S. PATENT DOCUMENTS 4,699,164 10/1987 Pilney et al. ..... 135/16

5,014,846 5/1991 Walker et al. ..... 206/5

*Primary Examiner*—Carl D. Friedman

*Assistant Examiner*—Matthew E. Leno

*Attorney, Agent, or Firm*—Chernoff, Vilhauer, McClung & Stenzel

[57] ABSTRACT

A system for protecting golf clubs and a golf bag from exposure to natural elements such as rain. The system includes a protective cover comprising a club head protector for covering the head of a respective golf club, a compartment, such as a hidden pocket, located on the club head protector, and a sack-like waterproof hood attached, by its closed end, to the inside of the hidden pocket. The system further includes a method of use of the protective cover which includes storing the hood out of view when the hood is not being used. If rainfall or other hazardous condition appears imminent, the method includes drawing the hood outwardly from the pocket and reversing the hood so that the club head protector is moved from a first position outside the hood to a second position inside the hood. After the rain or other hazardous condition has passed, the method includes reversing the hood a second time and reinserting the hood back into the compartment in such a manner as to trap and maintain the water droplets or other deposited matter inside the hood and so as to prevent drainage of water, for example, onto objects that are external to the protective cover.

7 Claims, 3 Drawing Sheets

PROTECTIVE SYSTEM FOR GOLF CLUBS AND BAG

BACKGROUND OF THE INVENTION

The present invention relates to protective covers for golf clubs and golf bags and, in particular, to such a cover that will protect one or more golf clubs, while all the clubs are arranged together in a golf bag, against exposure to natural elements of the type likely to be encountered on a golf course.

There are several different types of naturally-occurring conditions which are found on a golf course that can damage a golf club and bag. For example, if the clubs and bag are left uncovered during a light rain, water can collect inside or drain into the bottom of the bag, so that unless the bag is thoroughly dried after each use, the bottom of the bag can begin to mold or rot. Furthermore, because each golf club is normally stored with its handle toward the bottom of the bag, moisture can seep into and damage the material used to form the handle. Similarly, on a windy day, grains of sand particles may be blown toward the bag and may cling to the inside of the bag or on the clubs. Subsequent movement between the clubs and the bag, or between the clubs and each other, can damage the surface finish on the clubs. In addition to rain, sand, and dust, in some areas there is such a large number of birds which congregate on the course that fouling of the bag by bird droppings is also a problem.

In order to protect the clubs and the bag against these and other types of natural hazards, various protective systems have evolved. For example, Pilney, U.S. Pat. No. 4,699,164 discloses a hood-like rain fly on the central underside of which is attached a sock. After the sock is fitted over the head of one of the clubs in the bag, the mouth of the rain fly can be lifted over the remaining clubs and over the open upper end of the golf bag thereby protecting the clubs and the interior of the bag under a waterproof canopy.

If, however, the Pilney device is stored for use in ready position on one of the golf clubs, the loosely draped rain fly gives the device an untidy and gimmicky appearance. Moreover, in the event that a light breeze begins to blow, the rain fly can easily become a noisily flapping distraction. To avoid this problem, the owner may store the Pilney device inside a compartment of the golf bag, but this requires that the owner remember to always look inside the compartment, as when leaving the house for example, to check whether the device is in place.

Additional problems with the Pilney device occur after the rain fly has served its protective function. After exposure to rain, for example, the hood-like rain fly will be covered with water droplets. With the rain fly in this condition, it is unlikely that the owner will want to continue to carry the rain fly. In particular, it is not likely that the owner will want to carry the rain fly inside a compartment of the golf bag, because water can leak from the compartment into the bottom of the bag and cause damage, as already described, to the handles of the clubs or to the bottom portion of the golf bag. Although it is possible to tie the rain fly outside the bag, such as to one of the straps connected to the bag, when the owner has finished playing and has loaded the bag into his or her vehicle, the rain fly is then able to drain onto the seats or inside the trunk or wherever else the bag has been placed.

Accordingly, it is an object of the present invention to provide an improved system for protecting a golf club and golf bag from exposure to natural elements.

A related object of the present invention is to provide a system which is attractive in use and which does not require special effort on the part of the owner in terms of remembering to bring non-sport related equipment.

A further related object of the present invention is to provide such a system that specifically protects against rain and that can be conveniently carried after such an exposure without draining water to external items not a part of the system.

SUMMARY OF THE PRESENT INVENTION

The protective system of the present invention includes a protective cover having a head protector for covering the head of a respective golf club in combination with a flexible waterproof hood attached to the head protector. In particular, the head protector includes a compartment inside of which the hood is attached and can be stored. Preferably the compartment comprises a hidden pocket with respect to the head protector for storing the hood out of view when the hood is not in use.

A second aspect of the present invention includes an exemplary method for using the aforesaid protective cover. This method includes removing the hood substantially from the compartment, reversing the hood so that the head protector is moved from a first position outside the hood to a second position inside the hood, and covering the open end of the golf bag with the hood while maintaining the head protector in the second position. In this manner, the compartment of the head protector first encloses the hood in order to provide a neat and non-gimmicky appearance, and then the hood encloses the head protector in preparation for exposure to the natural elements. After rain or some other type of residual matter has collected on the now exposed "inner" surface of the hood, desirably the hood is reversed a second time, and the mouth of the hood is gathered together to trap the residual matter inside the hood. While the mouth of the hood is still gathered together, preferably the hood is tucked back into the compartment so that the hood forms a compacted mass having numerous folds or pleats.

DETAILED DESCRIPTION OF A PREFERRED EMBODIMENT

Figures 1, 2:
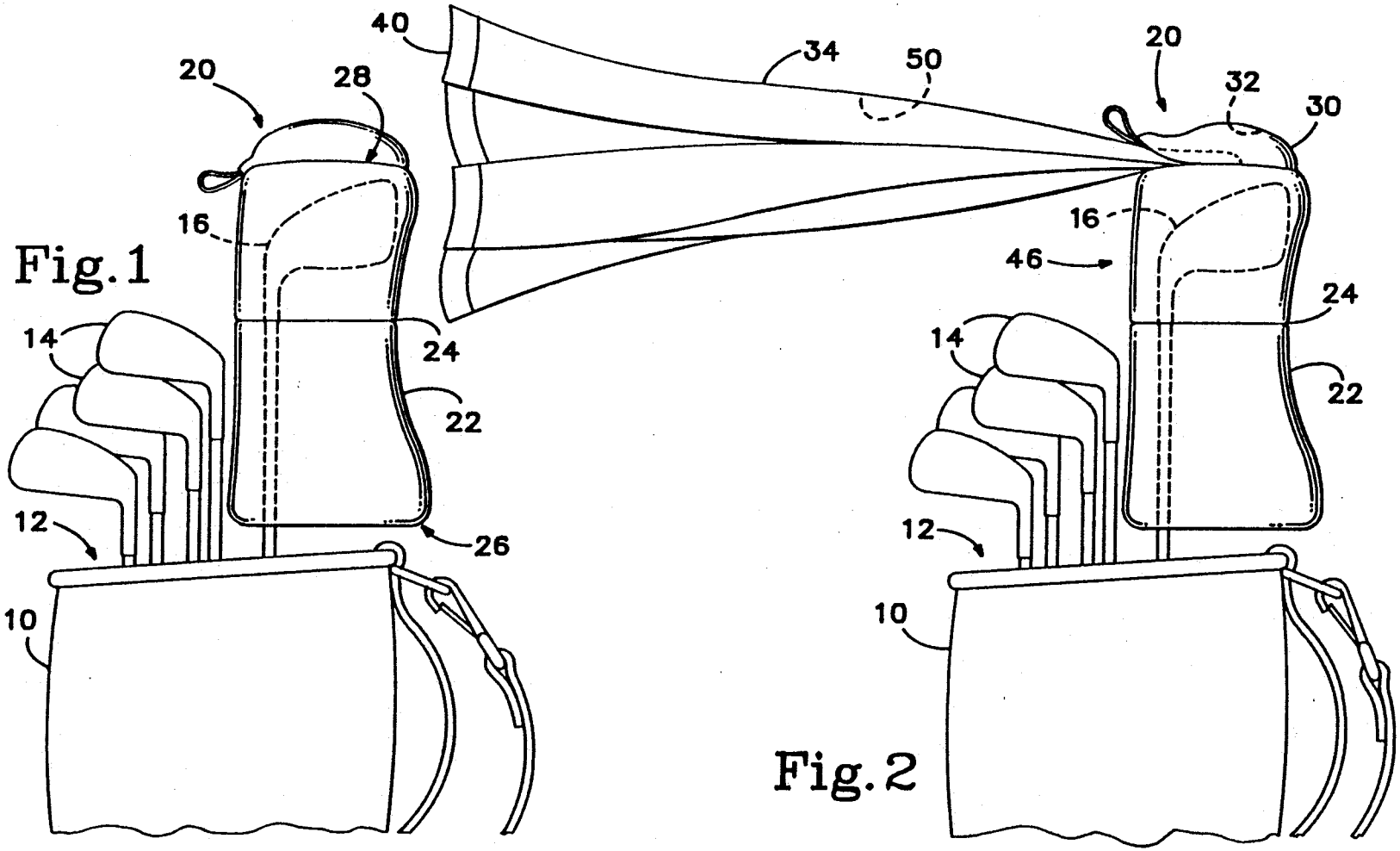
FIG. 1 is a side elevational view of an exemplary protective cover in accordance with the present invention being used to cover the head of a respective golf club which is arranged, together with other golf clubs, in a golf bag, as indicated in broken-away view.
FIG. 2 is a view of the protective cover of FIG. 1 but with a waterproof hood removed from a compartment included on the cover.

FIG. 1 depicts a golf bag 10 having an open end 12 in which are arranged numerous golf clubs which include several irons 14 and a wood 16. As is well known, the term "iron" or "wood" denotes the material used to form the head portion of each golf club. Covering the head portion of the wood, an exemplary protective cover 20 is shown which is constructed in accordance with the present invention and which generally conforms, in overall shape and external material, to a conventional club head protector. In particular, the head-protecting or bottom portion 22 of the device is of an open-centered, generally cylindrical shape having a narrowed segment 24 about midway between its open and closed ends, 26 and 28, for retaining the cover on the club head. Again conforming to conventional practice, the protective cover 20 is sewn together from a plush woolly-type fabric that will adequately protect the wood against damaging impact with the other clubs in the bag. These conventional elements of the exemplary protective cover 20 are purposefully incorporated not only for the sake of function but also so that the device will possess a tidy and familiar-looking appearance.

Figure 5:
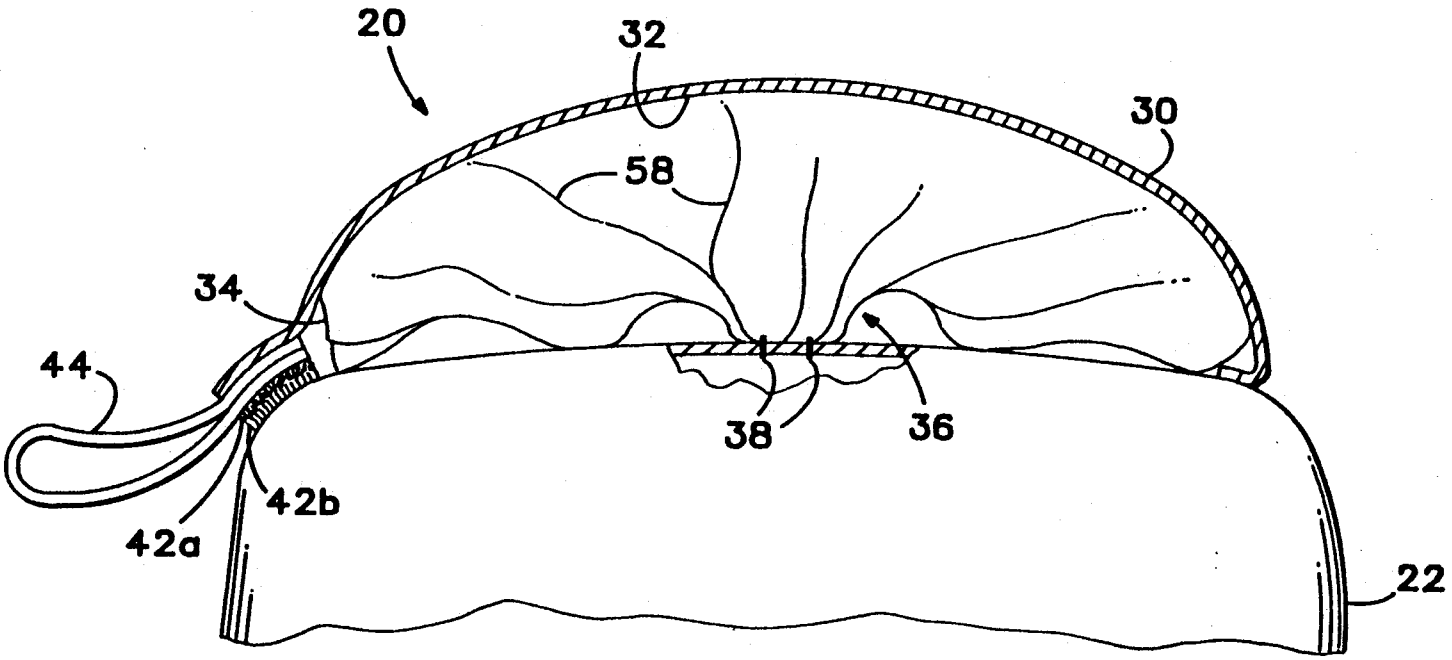
FIG. 5 is an enlarged view of the upper end of the protective cover, where portions of the compartment have been cut away to reveal the form that is preferably assumed by the hood after being inserted back into the compartment.

Referring to FIGS. 2 and 5, the upper portion 30 of the exemplary protective cover 20 defines a hidden pocket 32 integrally formed with the bottom portion 22 of the device. Inside this hidden pocket, a waterproof rain fly or hood 34 is attached. A suitable material for the hood is rip-resistant nylon that has been chemically treated with water repellant, such material being generally available, for example, through mountaineering outlets. This hood is preferably sack-like in shape and the closed end 36 of the hood is preferably attached inside the pocket by stitches 38 or some other such means as shown in FIG. 5. As shown in FIG. 2, the open end or mouth 40 of the hood can be drawn to a position outside of the pocket in preparation for use of the device.

As is evident from FIG. 2, when fully drawn to its outside position, the hood 34 is several times longer than the longest dimension of the hidden pocket 32. When the hood is stored inside the pocket, therefore, the flexible material out of which the hood is formed is wadded together in a very compressed or compacted mass as shown in FIG. 5. To prevent the hood 34 from protruding outside the pocket 32 prior to use of the hood, the mouth of the pocket is lined with opposing strips 42*a* and 42*b* of VELCRO TM which mate together to seal the pocket shut. In order to facilitate opening of the pocket after the pocket has been closed, a folded-over strip of fabric 44 is provided which is sewn into place between the roof of the pocket and the upper VELCRO TM strip 42*a*. This provides a convenient finger grip for lifting the upper VELCRO TM strip 42*a* from the bottom VELCRO TM strip 42*b*.

In the event that a rain storm, dust storm, or some other naturally occurring hazard appears to be imminent, use of the protective cover 20 proceeds as follows. Referring to FIG. 2, the hood 34 is drawn outwardly from the pocket to the fullest extent possible. Next, the hood is reversed so that the head-protecting or bottom portion 22 of the protective cover is moved from a first position 46 (FIG. 2) outside the hood to a second position 48 (FIG. 3) inside the hood. The mouth 40 of the hood is adjusted, as needed, so that the respective irons 14, the open end 12 of the golf bag 10, and the head-protecting or bottom portion 22 of the device itself are each protected under the waterproof canopy formed by the hood. Even in the presence of strong winds, the hood will maintain its position because it is anchored by the bottom portion 22 of the device which itself is retained over the wood by the narrowed segment 24.

Figure 4:
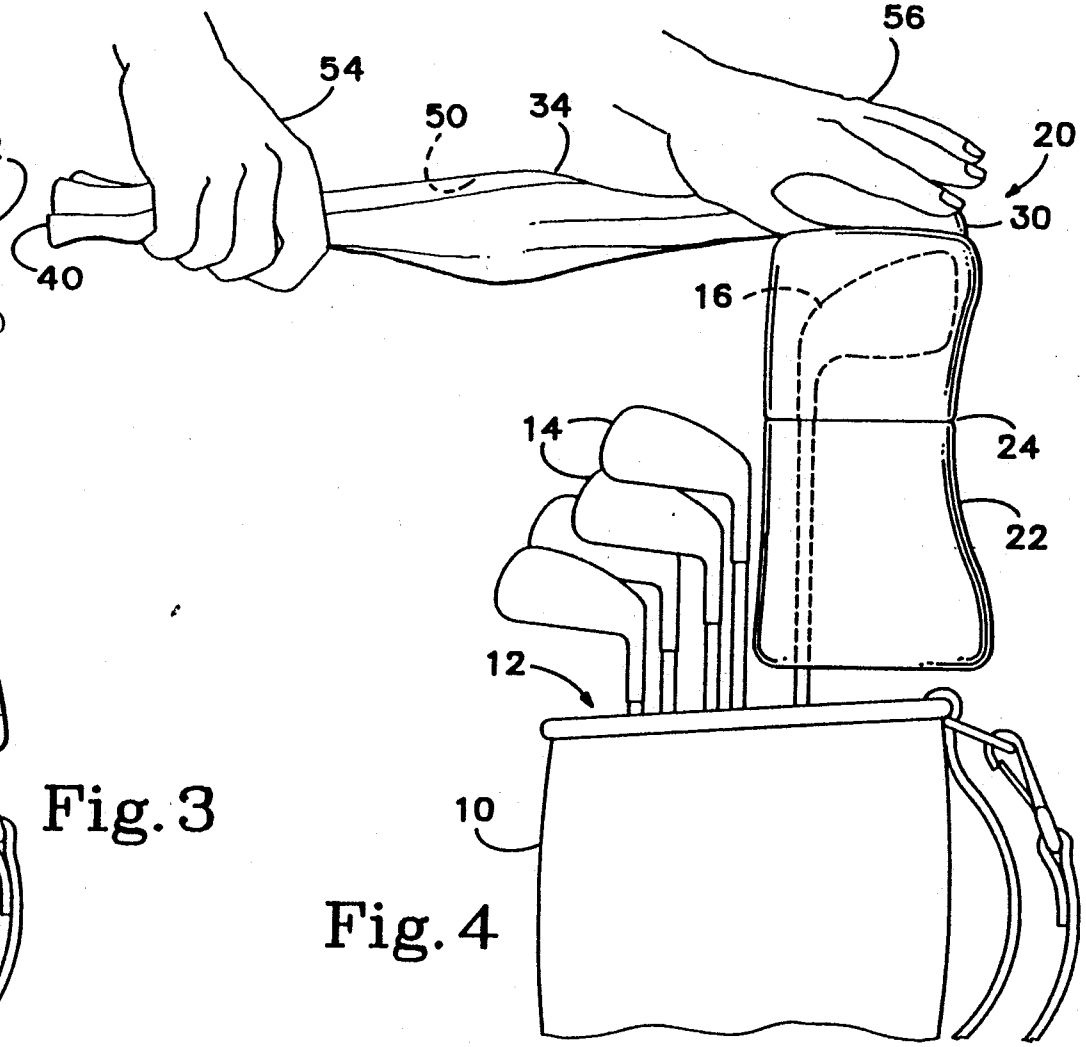
FIG. 4 is a view similar to FIG. 3 except showing the hood reversed a second time and a preferred approach to reinserting the hood back into the compartment of the exemplary cover.
Figure 3:
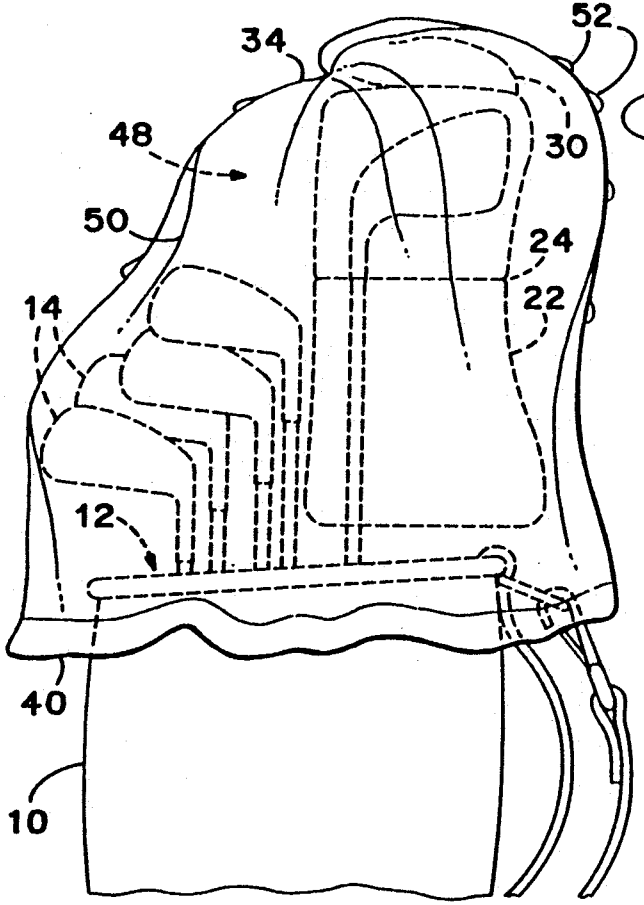
FIG. 3 is a view similar to FIG. 2 but where the hood has been reversed to form a protective canopy over each of the clubs and the upper end of the bag.

Comparing FIGS. 2 and 3, it will be evident that reversal of the hood 34 brings the inside surface 50 of the hood to the outside (FIG. 3). After the period of primary exposure has passed, that is, after it has stopped raining, for example, individual particles of matter such as water droplets 52 will be deposited on the inside surface 50. After the larger particles or droplets are gently shaken off, the hood is carefully reversed a second time with care being taken not to let any of droplets spill onto the golf bag 10 or the clubs 14. Referring to FIG. 4, the excess water droplets 52 or other particles now become trapped along the inside surface of the hood. With one hand 54, the mouth 40 of the hood is preferably gathered together so that no water or other matter can spill from the mouth, and with the fingers of the other hand 56, the hood is tucked back into the hidden pocket.

Referring to FIG. 5, the small interior dimensions of the hidden pocket 32 together with the repeated jabbing motion preferably used to tuck the hood back into the pocket, forces the hood into a compacted mass having numerous folds or pleats 58. Each fold or pleat acts as a barrier against movement by residual matter that has been trapped inside the hood. Accordingly, rain droplets that have collected inside the hood, for example, cannot drain from the hood into the pocket so that further drainage to items outside the pocket is prevented. In particular, moisture collected on the hood cannot seep into the bottom of the bag. Nor will moisture seep outside the device when the golf bag 10 and the clubs are laid on their side to fit inside the trunk or along the seats of a car.

Between uses, the protective cover 20 can be cleaned and dried just as would an ordinary club head protector. There is little risk that the user will forget to bring along the protective cover 20 because placing a head cover over the head of a club needing such protection is a normal precautionary measure that the owner of the club would attend to as a matter of course.

Although an exemplary protective cover 20, and its method of use, have now been shown and described, it will be evident from the foregoing description that modification of the exemplary cover is possible without departure from the broader principles of the present invention. For example, the location of the hidden pocket 32 does not need to be limited to the upper portion 30 of the protective cover. Nor, for example, is VELCRO TM the only type of fastener that is suitable for closing the mouth of the pocket.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A device for protecting one or more golf clubs, each having a head and each arranged in a golf bag having an open end, from exposure to natural elements, said device comprising:

(a) a head protector having a lower interior portion adapted for covering the head of a respective one of said golf clubs;

(b) a flexible waterproof hood attached to said head protector;

(c) mouth means included on said flexible waterproof hood for surrounding said open end of said golf bag; and (d) said head protector forming an opening, said opening being in communication with a storage region formed within said head protector or storing said hood.

2. The device of claim 1 wherein said storage region is formed by a pocket such that said storage region is separated from said lower interior portion.

3. The device of claim 1 wherein said head protector includes closure means for selectively closing said opening such that the presence of said opening is substantially concealed while said opening is closed.

4. The device of claim 1 wherein said storage region is substantially concealed from view.

5. A method for protecting one or more golf clubs arranged in a golf bag from exposure to natural elements comprising:

(a) providing a club head protector and a flexible waterproof hood that is attached to the inside of a storage region formed within the club head protector;

(b) removing the hood substantially from the storage region;

(c) reversing the hood so that the club head protector is moved from a first position outside the hood to a second position inside the hood; and (d) covering the open end of the golf bag with the hood while maintaining the club head protector in the second position.

6. The method of claim 5 further including the steps, after primary exposure of the hood to said natural elements, of reversing the hood a second time and of gathering together the mouth of the hood to trap said natural elements inside of the hood.

7. The method of claim 6 further including the step of reinserting the hood back into the storage region.

* * * * *

UNITED STATES PATENT AND TRADEMARK OFFICE

CERTIFICATE OF CORRECTION

PATENT NO. : 5,280,798

DATED : January 25, 1994

INVENTOR(S) : Eugene I. Helm

It is certified that error appears in the above-indentified patent and that said Letters Patent is hereby corrected as shown below:

In Column 5, Line 16, after "protector" delete "or" and insert --for--.

Signed and Sealed this

Sixth Day of June, 1995

Bruce Lehman

*Attest:*

BRUCE LEHMAN

*Attesting Officer*

*Commissioner of Patents and Trademarks*